US008544135B2

(12) United States Patent
Scott et al.

(10) Patent No.: US 8,544,135 B2
(45) Date of Patent: Oct. 1, 2013

(54) MULTI-MATERIAL CLEANING TOWEL WITH HAND POCKETS

(76) Inventors: Christina Scott, Kansas City, MO (US); Kevin Neighley, Kansas City, MO (US)

( * ) Notice: Subject to any disclaimer, the term of this patent is extended or adjusted under 35 U.S.C. 154(b) by 278 days.

(21) Appl. No.: 13/115,781

(22) Filed: May 25, 2011

(65) Prior Publication Data

US 2011/0289712 A1 Dec. 1, 2011

Related U.S. Application Data

(60) Provisional application No. 61/396,266, filed on May 25, 2010.

(51) Int. Cl.
*A47L 25/00* (2006.01)

(52) U.S. Cl.
USPC ..... 15/209.1; 15/118; 15/104.93

(58) Field of Classification Search
USPC ..... 15/104.93, 118, 209.1, 208; 401/201, 401/183; 428/102, 121–123, 190, 192, 193, 428/223; 442/346, 366
See application file for complete search history.

(56) References Cited

U.S. PATENT DOCUMENTS 5,694,659 A * 12/1997 Merrion ..... 15/214
5,804,279 A * 9/1998 Pluth ..... 428/124
5,902,661 A * 5/1999 Oster ..... 428/82
5,983,436 A * 11/1999 Mason et al. ..... 15/222
6,902,338 B2 * 6/2005 Puvvada et al. ..... 401/201

* cited by examiner

*Primary Examiner* — Shay Karls
(74) *Attorney, Agent, or Firm* — Hovey Williams LLP

(57) ABSTRACT

A towel for cleaning and drying a surface includes a first portion, a second portion, and a pocket formed in the first portion. The first portion includes an underlying layer of material and two outer layers of material. The second portion is formed primarily of a material different from the outer layer of the first portion. The pocket is formed in the first portion between the underlying layer and the outer layer for receiving a user's hand or foot.

11 Claims, 3 Drawing Sheets

MULTI-MATERIAL CLEANING TOWEL WITH HAND POCKETS

RELATED APPLICATIONS

This nonprovisional patent application claims priority benefit, with regard to all common subject matter, of earlier-filed U.S. provisional patent application titled "CLEANING TOWEL," Ser. No. 61/396,266, filed May 25, 2010. The identified earlier-filed application is hereby incorporated by reference in its entirety into the present application.

This application is also related to, and incorporates by reference, co-pending U.S. patent application Ser. No. 13/115,766, titled "MULTI-MATERIAL CLEANING TOWEL WITH POCKETS FOR CLEANING PRODUCTS," filed May 25, 2011.

BACKGROUND

The present invention relates to cleaning towels. More particularly, the invention relates to a cleaning towel specifically designed for cleaning vehicles, floors, countertops, or any other surfaces without the use of soap or other cleaning agents.

Many different cleaning towels, sponges, brushes, etc. have been developed for cleaning all types of surfaces. For example, cleaning towels are frequently used by auto dealers to clean vehicles on their lots to make them more attractive to potential buyers. Although many dealers have on-site car washes, it is often too time-consuming and costly to use them for frequent cleanings, especially for large dealers with many vehicles that must be cleaned several times a week. Therefore, many auto dealers clean, or hire others to clean, their vehicles in-place with portable or truck-mounted power washers or even with long garden hoses.

To reduce the runoff of soaps, detergents, and other cleaning agents into storm sewers (which typically drain directly to rivers, streams, or lakes), many governments prohibit the use of cleaning agents on surface lots and other areas that are not properly drained or filtered. Therefore, auto dealers typically must clean vehicles on their lots with water only. The same is true for auto detailers, individual car owners, and others who wash their vehicles in parking lots, driveways, and other areas that drain to storm sewers. Even when the use of soaps and detergents is not prohibited, many people prefer to eliminate or at least minimize the use of them for environmental reasons. Unfortunately, existing cleaning towels do not effectively clean and dry vehicles with water only. The same problems also apply to the cleaning of other surfaces such as floors, countertops, appliances, cabinets, etc.

SUMMARY

The present invention provides a distinct advance in the art of cleaning towels by providing a towel specifically designed for cleaning vehicles and other surfaces without the use of soap or other cleaning agents.

One embodiment of the towel broadly comprises a first portion; a second portion; and a pocket formed in the first portion. The first portion is formed primarily of an underlying layer of material and an outer layer of material that is folded over and attached to both faces of the underlying layer of material. The second portion extends from the first portion and is formed primarily of a material different from the material in the outer layer of the first portion. The pocket is formed in the first portion of the towel between the underlying layer and the outer layer.

In one embodiment, the outer layer of the first portion is made of microfiber material and the underlying layer is made of chamois material. The entire second portion of the towel is made of chamois material or similar materials. The first portion of the towel is thicker than the second portion.

To clean a vehicle or other surface with the towel, the surface may first be sprayed with water and/or the towel may be dipped in clean water and then wrung out to remove excess water. Alternatively, the towel may be used without any water for dusting purposes. A user may then place one or both hands in the pocket and wipe the towel across the surface with the first portion of the towel leading. The user may also place his or her foot or feet in the pocket or pockets and use the towel to clean a floor.

The first portion of the towel effectively removes dirt, water, and debris from the surface without scratching it. Because the first portion is thicker than the second portion, and because the pocket is located in the first portion, a user can place his hand or hands in the pocket and firmly compress the first portion of the towel against the surface to remove all dirt and contaminants therefrom. A user may also place his or her foot in the pocket and use the towel to clean and dry floors.

The second relatively thinner portion of the towel is formed primarily of water-absorbing chamois material and removes spots and streaks as it is dragged across the surface. Thus, a single towel constructed in accordance with embodiments of the invention may be used to simultaneously clean and dry a surface without soap or other cleaning agents and without leaving spots or streaks. After the towel is used to thoroughly clean and dry a surface, it may be washed and used again and again to clean other surfaces.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
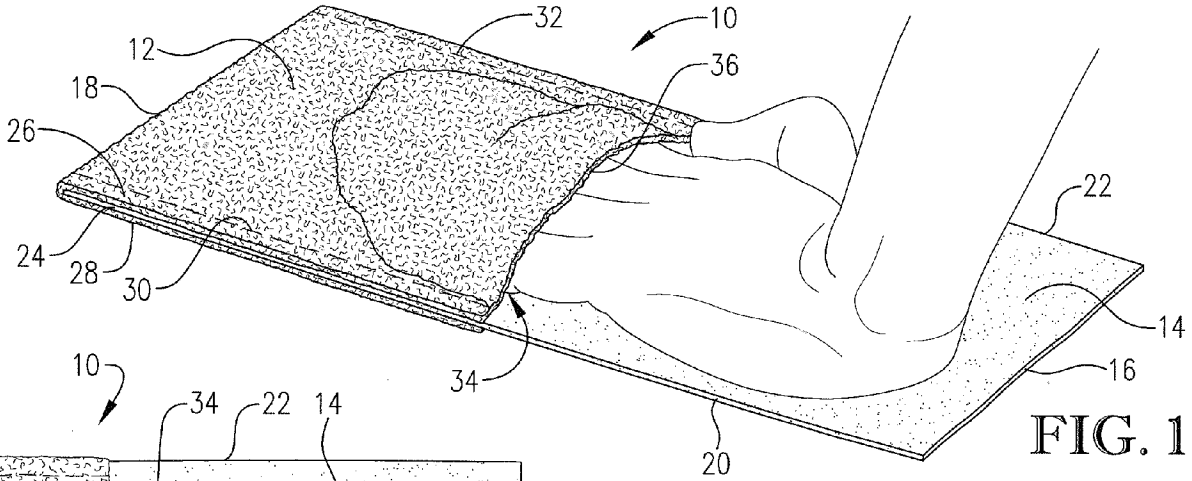
FIG. 1 is a perspective view of a cleaning towel constructed in accordance with an embodiment of the present invention and shown being used to clean a surface.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

The invention provides various embodiments of cleaning towels specifically designed for cleaning vehicles and other surfaces without the use of soap or other cleaning agents. The towels are primarily formed from microfiber material, chamois material, and/or similar materials and may be any size and shape. Although the towels are particularly useful for cleaning vehicles, they can also be used to clean floors, countertops, cabinets, appliances, or any other surfaces.

Figure 2:
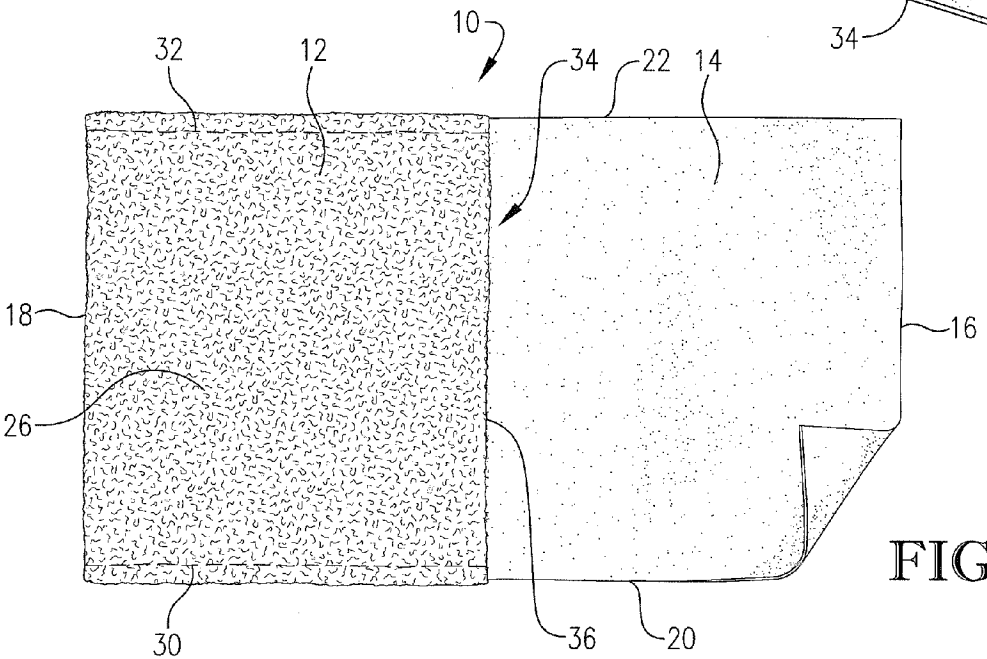
FIG. 2 is a top view of the cleaning towel of FIG. 1.

Turning now to the drawing figures, and initially FIGS. 1 and 2, a cleaning towel 10 constructed in accordance with a first embodiment of the invention is illustrated. The towel broadly comprises a first portion 12 and a second portion 14, each of which performs a different cleaning and/or drying function as discussed below. One embodiment of the towel is approximately 12" long measured between a trailing edge 16 and a leading edge 18 and approximately 5" wide measured between two side edges 20, 22. However, the towel may be of any size without departing from the scope of the present invention.

The first portion 12 comprises an underlying layer 24 and two outer layers 26, 28. The underlying layer 24 may be formed of a porous, non-abrasive natural leather chamois material or a synthetic chamois material designed to simulate natural leather chamois. The underlying layer 24 may also be formed of microfiber or other material that is more pliable and less expensive than chamois. The outer layers 26, 28 are formed of microfiber material or similar materials made from polyesters, polyamides, and/or a combination of these or other materials. The microfiber material preferably has a fiber with less than 1 denier per filament.

The underlying layer 24 may be approximately 1/16"-1/8" thick and each outer layer 26, 28 may also be approximately 1/16"-1/8" thick. Thus, the overall thickness of the first portion 12 may be between 3/16"-3/8" thick; however, it may be thicker or thinner without departing from the scope of the invention.

In one embodiment, the first portion 12 is formed by folding a piece of microfiber material or similar material over one edge of a larger piece of chamois or similar material and sewing or otherwise attaching the microfiber material to both faces of the underlying chamois material. Thus, the chamois material forms the underlying layer 24 and the folded-over microfiber material forms the outer layers 26, 28. The layers 24, 26, 28 may be secured to one another by several parallel stitch lines 30, 32 or attached with glue or by other conventional means.

In the illustrated embodiment, the underlying layer 24 underlies substantially the whole portion of the outer layers 26, 28. In other embodiments, the underlying layer may underlie only a portion of the outer layers 26, 28. This makes the first portion 12 more pliable by extending the relatively more flexible outer layers 26, 28 beyond the edge of the underlying layer 24.

The second portion 14 of the towel is preferably formed from a single layer of material such as chamois or equivalent materials. In one embodiment, the second portion 14 is an extension of the underlying layer 24 of the first portion 12. In other words, the second portion 14 and the underlying layer 24 of the first portion 12 may be formed from a single piece of chamois material. In one embodiment the second portion 14 is approximately 1/16"-1/8" thick; however, it may be thicker or thinner without departing from the scope of the invention. Because the second portion 14 consists of only one layer of material, it is approximately 1/3 the thickness of the first portion 12.

The first 12 and second portion 14 of the towel 10 may each occupy any percentage of the total surface area of the towel. In one embodiment, the first portion 12 occupies approximately 10-40% of the surface area of the towel and the second portion occupies 60-90% of the surface area. For example, if the towel is 12" long and 5" wide as described above, so that each face thereof has an approximate total surface area of 60 square inches, each face of the first portion may be 6-24 square inches and each face of the second portion may be 36-54 square inches. Such an embodiment, with a relatively small first portion 12, is particularly useful for cleaning vehicles and other surfaces that primarily just need to be dried and have spots and streaks removed. For example, the towel of this embodiment may be used to clean vehicles after a rainstorm.

In an alternate embodiment, the first portion 12 occupies a relatively larger percentage of the total surface of the towel 10. Specifically, the first portion 12 may occupy between 40-60% of the total surface area of the towel 10 and the second portion may occupy between 40-60% of the surface area. This embodiment is particularly useful for cleaning moderately dirty vehicles that need to be cleaned and have spots and streaks removed.

In another embodiment, the first portion 12 occupies an even larger percentage of the total surface of the towel. Specifically, the first portion 12 may occupy between 60-90% of the total surface area of the towel 10 and the second portion may occupy between 10-40% of the surface area. This embodiment is particularly useful for cleaning extremely dirty vehicles and other surfaces.

In accordance with an important aspect of the invention, a pocket 34 is formed in the first portion 12 of the towel for receiving a user's hand. In one embodiment, the pocket 34 is formed by leaving a trailing edge 36 of the outer layer 26 unattached to the underlying layer 24 so that the pocket is defined by the two stitch lines 30, 32 and the leading edge 18 of the towel where the outer layers 26, 28 fold over the underlying layer 24. For a 12"×5" towel, the pocket 34 may be approximately 4" wide measured between the stitch lines 30, 32 and 3-4" deep measured between edges 36 and 18. In other embodiments, additional stitch lines may be added between the stitch lines 30, 32 and/or in front of the leading edge 18 to form a smaller sized pocket. For larger towels, the pocket 34 may be wider and/or deeper. In some embodiments, a pocket may be formed on the opposite side of the towel in the same manner as described above.

In some embodiments, a waterproof or water-resistant liner made of rubber, plastic, or similar material may be sewn or otherwise attached inside the pocket 34 to keep the user's hand dry during use of the towel. In other embodiments, the opening of the pocket may include an elastic band to secure the towel on the user's hand while in use.

To clean a vehicle or other surface with the towel 10, the surface may first be sprayed with water or the towel may be dipped in clean water and then wrung to remove excess water. Alternatively, the towel may be used without any water. A user may then place one or both hands in the pocket 34 and wipe the towel across the surface with the first portion 12 leading. The user may also place his or her foot or feet in the pocket or pockets and use the towel to clean a floor.

Because the first portion 12 of the towel includes outer layers 26, 28 of microfiber material, it effectively removes dirt, water, and debris from the surface without scratching it. Also, because the pocket 34 is located in the first portion 12 and the first portion is thicker than the second portion 14, a user can firmly compress the first portion against the surface to remove all dirt and contaminants therefrom. Because the second relatively thinner portion of the towel is formed primarily of water-absorbing chamois material, it removes spots and streaks as it is dragged across the surface. Thus, a single towel constructed in accordance with embodiments of the present invention may be used to simultaneously clean and dry a surface without soap or other cleaning agents and without leaving spots or streaks. After the towel 10 is used to thoroughly clean and dry the surface, it may be washed and used again and again to clean other surfaces.

Figure 3:
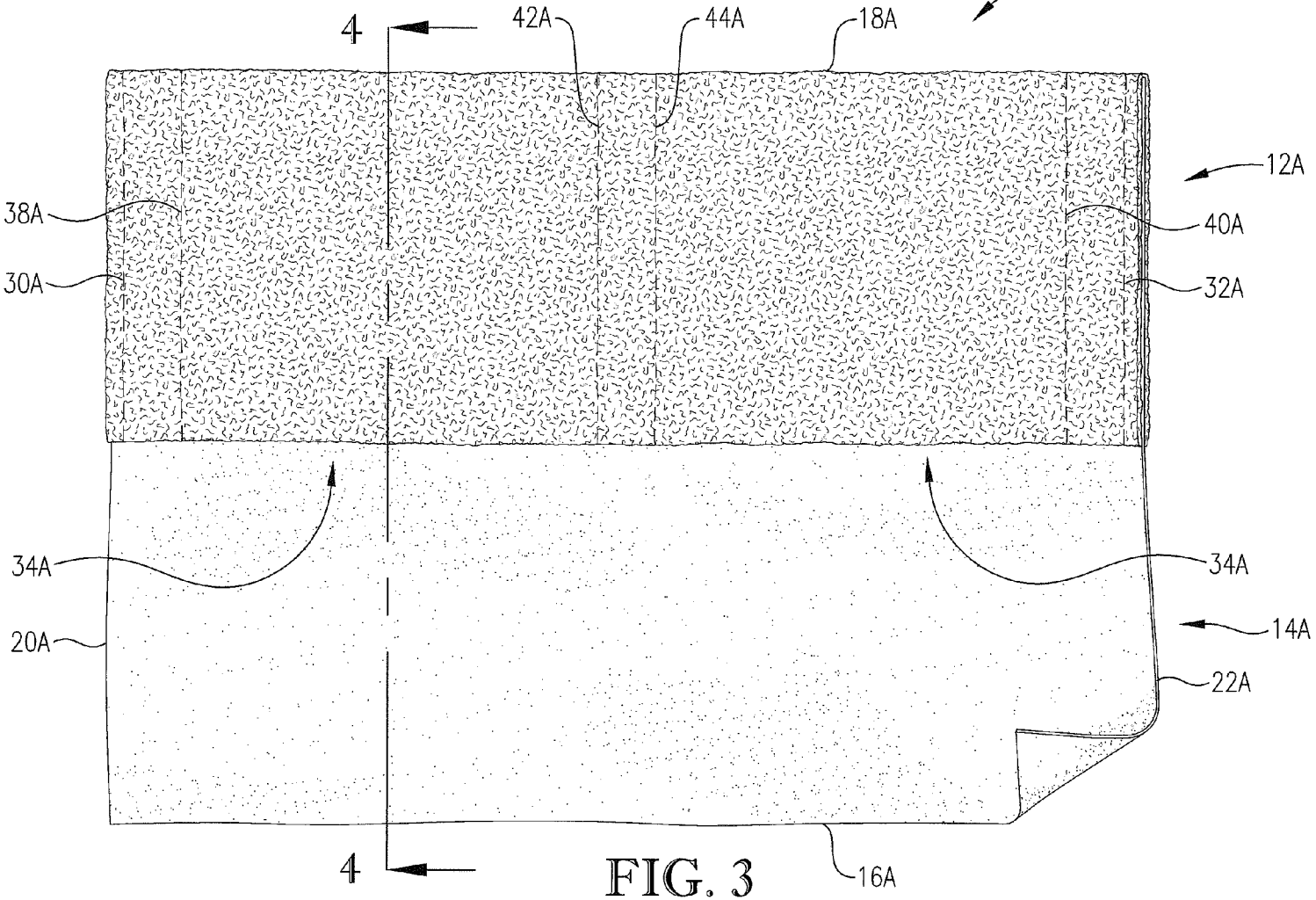
FIG. 3 is a top view of a cleaning towel constructed in accordance with another embodiment of the invention.
Figure 4:
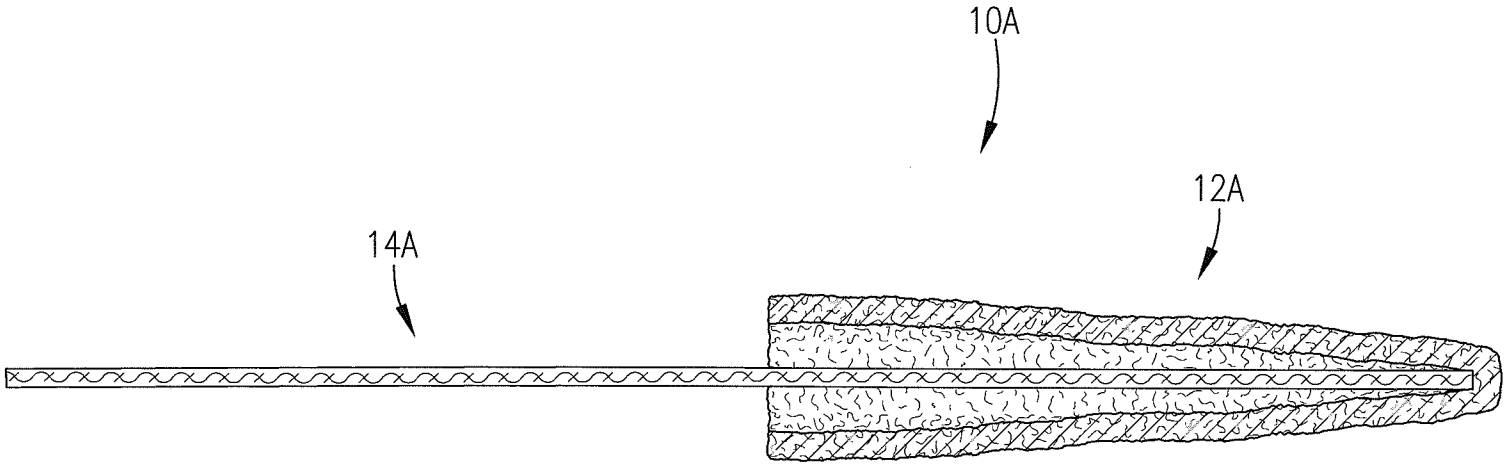
FIG. 4 is a vertical sectional view of the cleaning towel of FIG. 3 taken along line 4-4 of FIG. 3.

A cleaning towel 10A constructed in accordance with other embodiments of the invention is illustrated in FIGS. 3 and 4. The cleaning towel 10A is similar to the cleaning towel 10 shown in FIGS. 1 and 2, thus similar components are identified by the same reference numerals followed by the letter "A".

The primary differences in the cleaning towel 10A is that it is larger than the cleaning towel 10 and includes two pockets 34A rather than one. In one embodiment, the towel is approximately 10-12" long measured between edges 16A and 18 and 15-17" wide measured between side edges 20A and 22A. In another embodiment, the towel is approximately 10-12" long and 21-24" wide; however, it may be other sizes.

In addition to two outer stitch lines 30A, 32A, the towel 10A includes interior stitch lines 38A, 40A, 42A, 44A that define the two pockets 34A. In one embodiment, each of the pockets is approximately 4" wide and 3-4" deep, but they may be of other sizes without departing from the scope of the invention. Two pockets may be formed on the opposite side of the towel in the same manner.

In other embodiments, a pocket or pockets may be formed in the first portion of the towel for holding soaps, disinfectant towels, and/or other cleaning agents. One such pocket is disclosed in U.S. Patent Application Ser. No. 61/123,690, titled "Cleaning Towel", filed on Apr. 7, 2000, which is hereby incorporated into the present application in its entirety by reference. Other embodiments of such pockets are described in the co-pending application identified in the Related Applications section on page 1 of this application. For example, referring to FIG. 1, an additional stitch may be provided between stitch lines 30 and 32 about one inch from edge 18 to form a pocket near the edge 18. A slit or other opening may then be formed in the pocket to receive soaps, disinfectant towels, etc.

Although the invention has been described with reference to the embodiments illustrated in the attached drawing figures, it is noted that equivalents may be employed and substitutions made herein without departing from the scope of the invention as recited in the claims. For example, the towels described herein can be made in any size and shape without departing from the scope of the invention. Also, although the towels are particularly useful for cleaning and drying vehicles, they can be used to clean other objects and surfaces such as boats, bikes, floors, table tops, cabinets, appliances, etc.

Having thus described embodiments of the invention, what is claimed as new and desired to be protected by Letters Patent includes the following:

1. A towel for cleaning and drying a surface, the towel comprising:

a first portion formed primarily of an underlying layer of chamois material, a first outer layer of microfiber material attached to one face of the underlying layer of chamois material, and a second outer layer of microfiber material attached to an opposite face of the underlying layer of chamois material;

a second portion formed primarily of chamois material that is an extension of the underlying layer in the first portion;

a first pocket formed in the first portion between a first face of the underlying layer of chamois material and the first outer layer of microfiber material for receiving a user's hand; and a second pocket formed between a second face of the underlying layer of chamois material and the second outer layer of microfiber material for receiving the user's hand.

2. The towel as set forth in claim 1, wherein the first portion occupies approximately 10%-60% of a total surface area of the towel.

3. The towel as set forth in claim 1, wherein the first portion is approximately ⅛" to ⅜" thick.

4. The towel as set forth in claim 1, wherein the second portion is approximately 1/16" to ⅛" thick.

5. The towel as set forth in claim 1, wherein each of the first and second pockets are approximately 5" wide and 4-5" deep.

6. A towel for cleaning and drying a surface, the towel comprising:

a first portion formed primarily of an underlying layer of a first material, a first outer layer of a second material attached to one face of the underlying layer of the first material, and a second outer layer of the second material attached to an opposite face of the underlying layer of the first material;

a second portion formed primarily of the first material that is an extension of the underlying layer in the first portion;

a first pocket formed in the first portion between a first face of the underlying layer of the first material and the first outer layer of the second material for receiving a user's hand; and a second pocket formed between a second face of the underlying layer of the first material and the second outer layer of the second material for receiving the user's hand.

7. The towel as set forth in claim 6, wherein the first portion occupies approximately 10%-60% of a total surface area of the towel.

8. The towel as set forth in claim 6, wherein the first portion is approximately ⅛" to ⅜" thick.

9. The towel as set forth in claim 6, wherein the second portion is approximately 1/16" to ⅛" thick.

10. The towel as set forth in claim 6, wherein each of the first and second pockets are approximately 5" wide and 4-5" deep.

11. The towel as set forth in claim 6, wherein the first material is chamois and the second material is microfiber.

* * * * *